United States Patent [19]

Irvine

[11] 4,185,709

[45] Jan. 29, 1980

[54] DOCUMENT WEIGHING APPARATUS

[75] Inventor: Robert Irvine, Riverside

[73] Assignee: Pitney Bowes Inc., Stamford, Conn.

[21] Appl. No.: 965,108

[22] Filed: Nov. 30, 1978

[51] Int. Cl.[2] ..... B07C 5/20

[52] U.S. Cl. ..... 177/145; 209/900; 271/2; 271/229

[58] Field of Search ..... 177/145, 253; 271/2, 271/182, 229, 245, 246; 209/900, 934; 198/633

[56] References Cited

U.S. PATENT DOCUMENTS

| | | | |
|---|---|---|---|
| 3,016,126 | 1/1962 | Beytes | 198/633 X |
| 3,869,117 | 3/1975 | Yoshimura | 271/182 X |
| 3,894,734 | 7/1975 | Sette | 271/2 |

*Primary Examiner*—Joseph W. Hartary
*Attorney, Agent, or Firm*—Donald P. Walker; William D. Soltow, Jr.; Albert W. Scribner

[57] ABSTRACT

Document weighing apparatus is provided which includes a scale having a channel-shaped document weighing platform. The platform defines a passageway for receiving vertically oriented documents serially fed to the platform. In addition, the apparatus includes document decelerating instrumentalities comprising a pair of flexure springs mounted for movement between a passageway restricting position and a non-passageway restricting position. The flexure springs are oriented with respect to each other, when disposed in the passageway restricting position, for cooperatively progressively restricting the passageway in the direction of downstream movement of documents; thereby to exert decelerating forces on the opposed major surfaces of documents in the passageway. In addition, the apparatus includes instrumentalities for moving the flexure springs. Further, each of the free ends of the flexure springs is oriented to resist upstream movement of documents in the passageway when the springs are disposed in the passageway restricting position; thereby to halt upstream movement of documents which bounce off the document decelerating instrumentalities.

9 Claims, 5 Drawing Figures

DOCUMENT WEIGHING APPARATUS

BACKGROUND OF THE INVENTION

In the field of continuous mail handling, it is well-known in the art to provide systems which automatically weigh and meter mail pieces of different thickness. For example, as shown in U.S. Pat. No. 3,877,531, issued to Storace et al., Apr. 15, 1975, and assigned to the assignee of the present invention; there is disclosed a continuous mail sorting, weighing and postage imprinting system, wherein mixed mail pieces of different thickness are serially fed to a weighing station, where the mail pieces are individually weighed for the purpose of calculating the postage needed for mailing purposes, and then fed to a postage imprinting station, where postage is imprinted on the individual mail pieces.

As is generally shown and described in the aforesaid patent, and disclosed in greater detail in U.S. Pat. No. 3,894,734, issued to Sette et al., July 15, 1975, and assigned to the assignee of the present invention; it is well-known in the art to provide document decelerating mechanisms at weighing stations for slowing downstream movement of respective mail pieces for weighing purposes. In the Sette et al. patent there is described a decelerating mechanism which comprises a pair of cooperatively acting fingers, operative between open and closed positions, wherein the fingers converge toward one another when disposed in the closed position to provide a progressively restrictive passageway for incoming mail pieces. When the mail pieces contact the fingers, the fingers are moved by the mail pieces against the resistance of springs associated with the respective fingers. The springs tend to hold the fingers in their closed position. After the fingers decelerate the respective mail pieces to a complete halt, the fingers are separated to deposit the mail pieces upon the weighing platform of the scale for weighing purposes.

In the above described document weighing apparatus, it has been found that even when the mass of the respective finger members has been reduced as much as is possible consistent with maintaining stiffness of the fingers, the relatively thin mail pieces of a random group of mail pieces of different thickness cannot deflect the fingers against the resistance of the associated springs. This occurs due to the relatively thin, and thus light in weight, mail pieces not impacting the fingers with sufficient force to separate the fingers against the tension of the springs; as a result of which the fingers do not exert decelerating forces on the opposed major surfaces of the mail pieces. Rather, the mail pieces bounce back from the finger members to move upstream within the passageway.

Of course, the relatively thick mail pieces of the random group of mail pieces of different thickness are decelerated as discussed in Sette et al. Accordingly:

an object of the present invention is to provide improved apparatus for weighing documents of different thickness serially fed to a scale;

another object is to provide document weighing apparatus including a scale and improved means for decelerating downstream movement of respective documents serially fed to the scale; and yet another object is to provide means for decelerating movement of documents serially fed to a scale platform, including a pair of flexure springs mounted for movement between document decelerating and non-decelerating positions.

SUMMARY OF THE INVENTION

Apparatus for weighing documents of different thickness serially fed thereto, comprises a scale including a channel shaped document weighing platform which defines a passageway for receiving vertically oriented documents. The platform includes a bottom wall, for guiding respective lower edges of the documents, and opposed side walls, for guiding the opposed major surfaces of the documents. In addition, the apparatus includes means for decelerating movement of documents in the passageway, including a pair of flexure springs mounted for movement between a passage way restricting position and a non-passageway restricting position. The flexure springs are oriented with respect to each other, when disposed in said passageway restricting position, for cooperatively progressively restricting the passageway in the direction of downstream movement of documents; thereby exert decelerating forces on the opposed major surfaces of the respective documents. Further, the apparatus includes means for moving the flexure springs. And, preferably, each of the flexure springs has its free end oriented to resist upstream movement of documents in the passageway when the springs are disposed in said passageway restricting position.

BRIEF DESCRIPTION OF THE DRAWINGS

As shown in the drawings, wherein like reference numerals designate like or corresponding parts throughout the several figures.

DESCRIPTION OF THE PREFERRED EMBODIMENT

Figure 1:
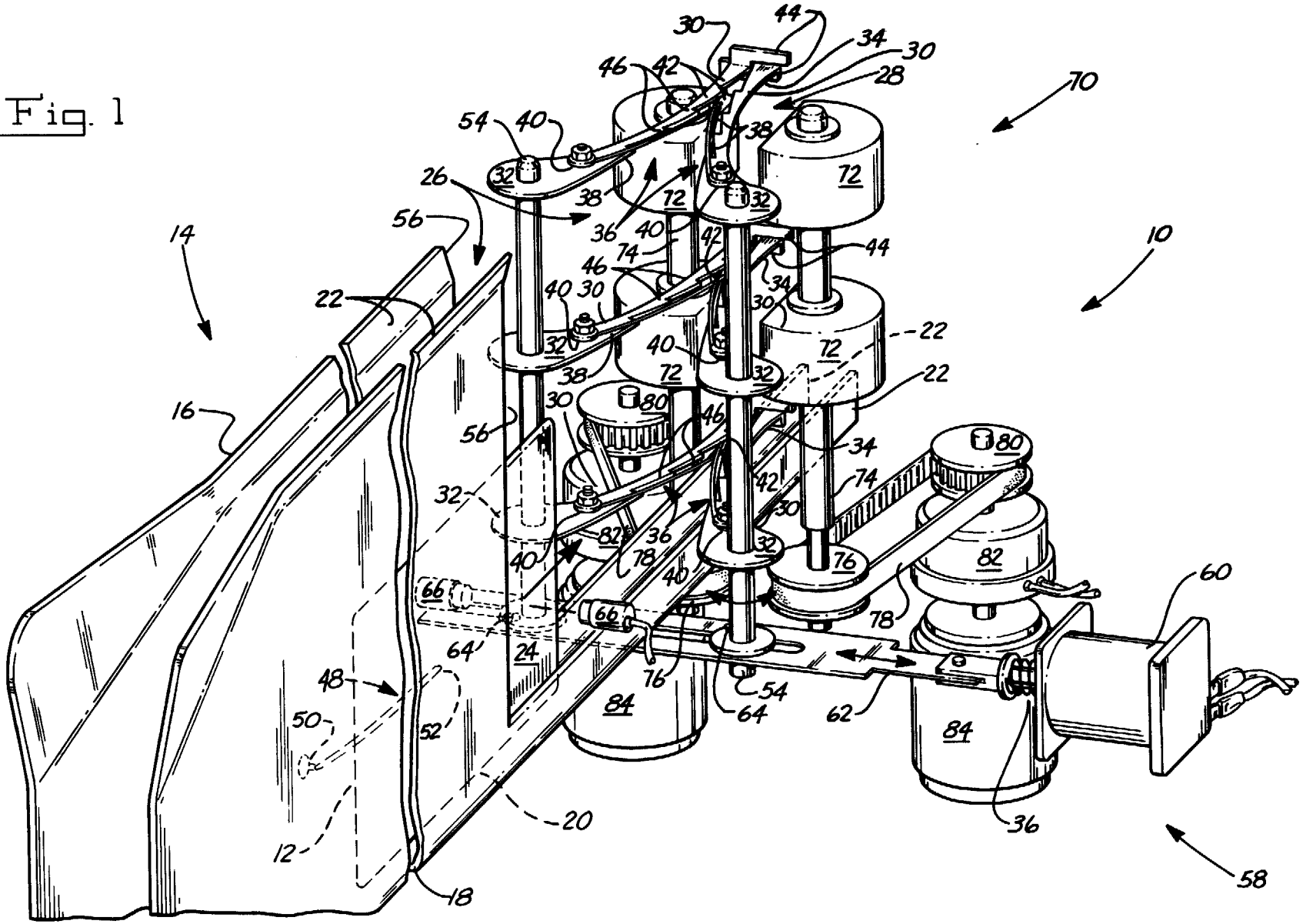
FIG. 1 is a perspective view of document weighing station including the document decelerating apparatus according to the invention.

The improved document weighing apparatus 10, for weighing documents 12 of different thickness serially fed thereto, includes a suitable scale 14, for example of the type shown in U.S. Pat. No. 3,894,734, issued to Sette et al., July 15, 1975; the subject matter of which is incorporated by reference. In the preferred embodiment of the present invention the scale 14 includes a channel-shaped document weighing platform 16 for receiving vertically oriented documents 12 serially fed to the platform 16. The platform 16 has a bottom wall 18 for guiding respective lower edges 20 of the documents 12; and has opposed side walls 22 for guiding the opposed major surfaces 24 (one of which is shown in FIG. 1) of the respective documents 12. The walls 18 and 22 cooperatively define a passageway 26 for receiving documents 12 fed to the scale platform 16. Preferably the bottom wall 18 longitudinally extends in the direction of downstream movement of respective documents 12 a greater distance than a major portion of the platform side walls 22.

Figure 2:
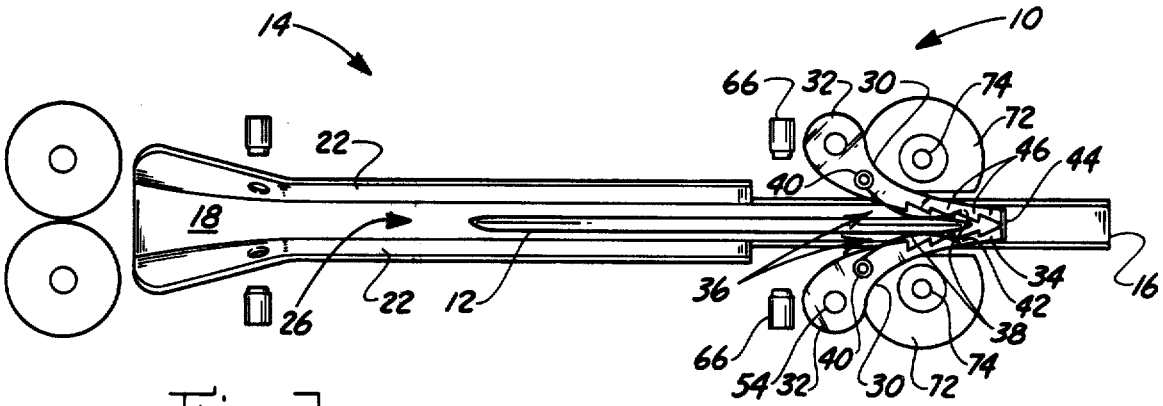
FIG. 2 is a plan view of the document decelerating apparatus, positioned for decelerating downstream movement of relatively thick documents.
Figure 3:
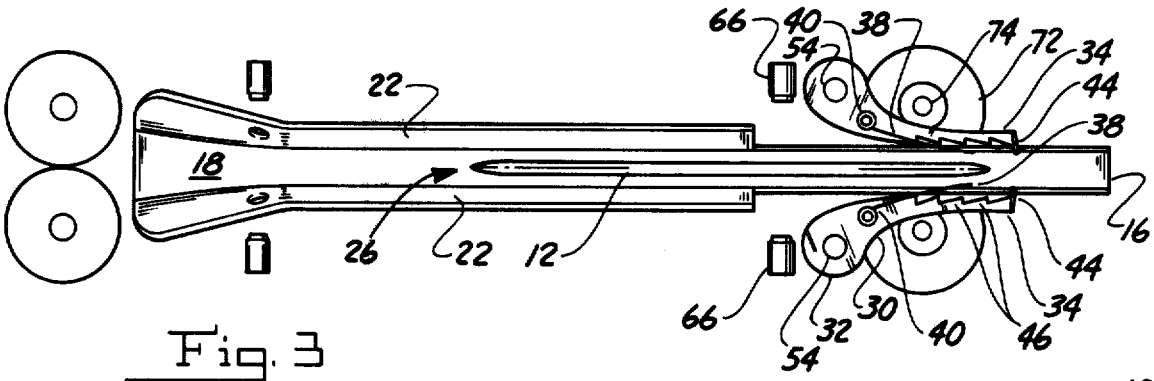
FIG. 3 is a view of the apparatus of FIG. 2 positioned to permit downstream movement of documents in the passageway after weighing.

The document weighing apparatus 10 also includes suitable means 28 (FIG. 1) for decelerating downstream movement of relatively thick, and thus relatively heavy in weight, documents 12 of a random group of documents 12 of different thickness in the passageway 26. The thick documents decelerating means 28 includes, as shown in the aforesaid U.S. Patent and in FIG. 1, a plurality of elongated, curvedly extending fingers 30, each of which has a held end 32 and a free end 34. The respective fingers 30 are mounted for movement between a passageway restricting position (FIG. 2) and a non-passageway restricting positioned (FIG. 3). Each of the fingers 30 is oriented with respect to another of the fingers 30, when disposed in the passageway restricting position (FIG. 2), for cooperatively progressively restricting the passageway 26 in the direction of downstream movement of respective documents 12 in the passageway 26; such that the fingers 30 exert decelerating forces on the opposed major surfaces 24 of respective documents 12 disposed between the fingers 30. The respective fingers 30 are suitably spring loaded toward the passageway 26, as by means of a coil spring 36, to resist the tendency of respective documents 12 to separate the opposed fingers 30 from each other.

Figure 4:
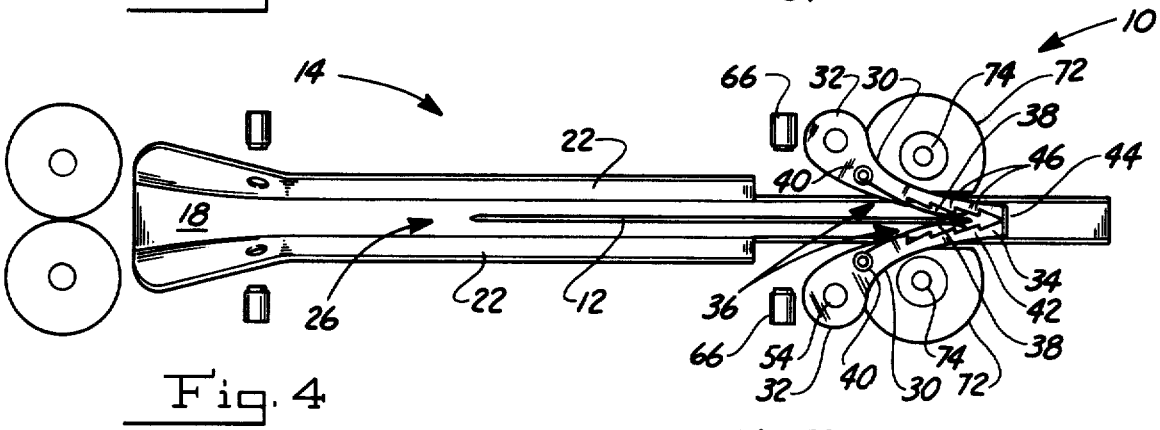
FIG. 4 is a plan view of the document decelerating apparatus, positioned for decelerating downstream movement of relatively thin documents.
Figure 5:
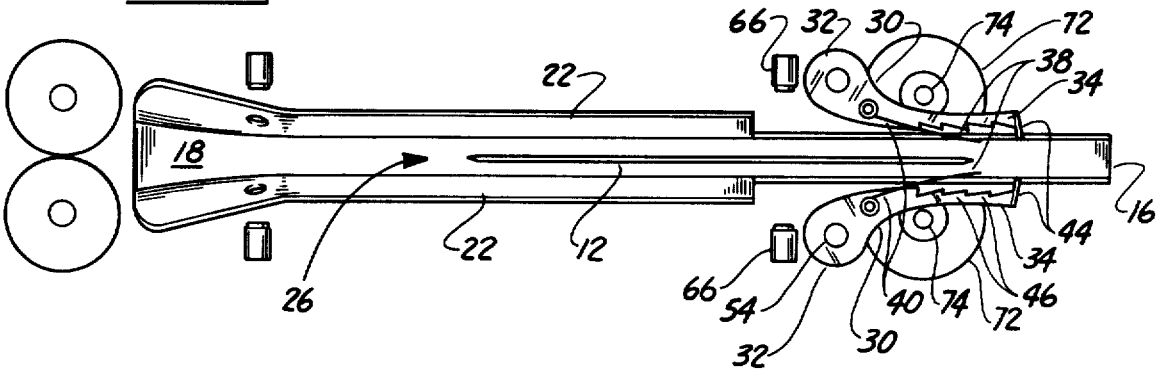
FIG. 5 is a view of the apparatus of FIG. 4 showing the decelerating apparatus positioned to permit downstream movement of thin documents after weighing.

The document weighing apparatus 10 (FIG. 1) also includes means 36 for decelerating downstream movement of the relatively thin, and thus relatively light in weight, documents 12 of the random group of documents 12 of different thickness. The thin document decelerating means 36 includes a plurality of elongated flexure springs 38, each of which has a held end 40 and a free end 42. The respective flexure springs 38 are mounted for movement between a passageway restricting position (FIG. 4), and a non-passageway restricting position (FIG. 5). In addition, each of the springs 38 (FIG. 1) is oriented with respect to another of the springs 38, when disposed in the passageway restricting position, for cooperatively progressively restricting the passageway 26 in the direction of downstream movement of respective documents 12; such that the springs 38 (FIG. 3) exert decelerating forces on the opposed major surfaces 24 of respective documents 12 disposed between the springs 38.

The fingers 30 (FIG. 1) respectively include a stop 44 extending from the free end 34 of the associated finger 30; such that when the fingers 30 are disposed in the passageway restricting position (FIG. 2) the stops 44 extend transverse to the passageway 26 and transverse to the direction of downstream movement of respective documents 12 therein. As thus oriented, the stops 44 obstruct the downstream passage of respective moving documents 12. Any documents 12 which are not brought to rest in the course of being decelerated by either the fingers 30 or springs 38 are prevented from moving upstream on the scale platform 16 by the free ends 42 of the flexure springs 38; inasmuch as the spring ends 34 are oriented in the passageway 26, when the springs 38 and fingers 30 are disposed in the passageway restricting position, so as to resist upstream movement of respective documents 12 in the passageway 26. In addition, the fingers 30 may include, as shown in the above-referenced patent and in FIG. 1, a plurality of teeth 46 extending therefrom and oriented with respect to documents 12 so as to resist upstream movement of documents 12 in the passageway 26. Further, to decelerate and obstruct upstream movement of extremely thin documents 12, which may bounce off the springs 38, an additional flexure spring 48 may be provided. The additional spring 48 has one end 50 suitably fixedly attached to one of the side walls 22 of the platform 16 for vertical movement therewith, and the other end 52 disposed in the passageway 26 and oriented with respect to upstream moving documents 12 for resisting upstream movement of such documents 12.

To move the fingers 30 and springs 38 between the passageway restricting and non-restricting positions, the document weighing apparatus 10 (FIG. 1) additionally includes suitable means, such as a pair of parallel-spaced vertically oriented rotatable shafts 54 on which the respective finger ends 32 are mounted.

Without departing from the spirit and scope of the invention, the respective spring ends 40 may be either suitably fixedly mounted on the fingers 30 for movement therewith, as shown in FIG. 1, or directly fixedly mounted on the associated shafts 54 for movement with the shafts 54. The respective shafts 54 are located on opposite sides of the passageway 26 and extend substantially parallel to the respective side walls of 22 of the document platform 16. The springs 38 and fingers 30 are vertically spaced apart from each other to facilitate decelerating documents 12 of different height fed to the platform 16. In addition, as shown in FIG. 1, the respective shafts 54 are disposed immediately downstream from the downstream ends 56 of the aforesaid major positions of the side walls 22 of the platform 16. As a consequence, the springs 38 (FIGS. 3 and 5) cooperate to act as extensions of the respective side walls 22, when the springs 38 are disposed in the non-passageway restricting position. On the other hand, due to the bottom wall 18 of the platform 16 extending downstream of the major portions of the side walls 22, the fingers and springs, 30 and 38, are disposed over the bottom wall 18 of the platform 16 when they are disposed in the passageway restricting position. Accordingly, when the springs and fingers, 30 and 38, are separated from each other, any document 12 held between the same is deposited on the bottom wall 18 of the scale platform 16 for weighing purposes.

For timely rotating the shaft 54, and thus for moving the fingers 30 and springs 38 as hereinbefore described, there is provided suitable means 58, including for example a solenoid 60; a push rod 62, suitably connected to the solenoid 60 for actuation thereby; and means 64, coupling the respective shafts 54 and push rod 62, for converting linear movement of the push rod 62 to appropriate rotary movement of the shafts 54. In addition, for timely rotation of the shafts 54 there is provided suitable document sensing means 66, such as photocell means, operatively soupled by means well-known in the art to the solenoids 60. The sensing means 66 senses the arrival of respective documents 12 at a predetermined position in the said passageway 26. And, the solenoid 60 is operatively connected by well-known means to the sensing means 66 for moving the fingers 30 and flexure springs 38 out of the passageway 26 a predetermined time interval after sensing the arrival of respective documents 12; the time interval being sufficient to permit respectively sensed documents 12 to settle on said platform 16. In addition, the solenoids 60 are operatively connected, by well-known means, to the scale 14 for moving the fingers 30 and flexure springs 38 into the passageway 26 after a second predetermined time interval sufficient to permit respectively sensed documents 12 to be weighed on the platform 16 and removed therefrom.

In accordance with the invention, the document weighing apparatus 10 preferably includes document feeding means 70, for removing documents 12 from the platform 16 after weighing. The document feeding means 70 includes a plurality of D-shaped rollers 72 which are arranged in tiers on opposite sides of the passageway 26 and respectively disposed between respective sets of springs 36 and fingers 38. In addition, the document feeding means includes a pair of spaced parallel shafts 74, on which the D-rollers 72 on each side of the passageway 26 are mounted for rotation therewith, and suitable means for timely rotating the respective shafts 74 after weighing the respective documents 12. The shaft rotating means preferably includes, for each shaft 74, a pulley 76 which is fixedly connected to the shaft 74; and a belt 78, looped around the pulley 76 for rotation thereof. In addition the shaft rotating means includes a second pulley 80 about which the belt 78 is also looped for driving the belt 78 and thus the pulley 76 and shaft 74. Further, the shaft rotating means includes a clutch 82, to which the pulley 80 is suitably connected, for rotation of the pulley 80 when the clutch 82 is energized; and includes a continuously suitably driven motor 84 connected by conventional means to the clutch 82 for rotation thereof. In addition, the clutch 82 is operatively connected by conventional means to the solenoid 60 or sensing means 66 for timely energizing the clutch 82, to interconnect the motor 84 and pulley 80; thereby to timely rotate the pulley 80 and thus the D-rollers 72, after respective documents 12 have been weighed on the scale 14, to feed the documents 12 from the scale 14.

In accordance with the objects of the invention there have been described improved apparatus for weighing documents of different thickness serially fed to the platform of a scale including flexure springs mounted for movement between document decelerating and non-decelerating positions.

Inasmuch as certain changes may be made in the abovedescribed invention without departing from the spirit and scope of the same, it is intended that all matter contained in the above description or shown in the accompanying drawings shall be interpreted in an illustrative rather than limiting sense. And, it is intended that the following claims may be interpreted to cover all the generic and specific features of the invention herein described.

What is claimed is:

1. Apparatus for weighing documents of different thickness serially fed thereto, said apparatus comprising:

a. a scale including a channel-shaped document weighing platform for receiving vertically oriented documents serially fed thereto, said platform including a bottom wall for guiding respective lower edges of documents fed to said platform, said platform including opposed side walls for guiding opposed major surfaces of respective documents fed to said platform, whereby said walls cooperatively define a passageway for documents fed to said platform;

b. means for decelerating movement of respective documents in said passageway, said decelerating means including a pair of flexure springs mounted for movement between a passageway restricting position and a non-passageway restricting position, said flexure springs oriented with respect to each other when disposed in said passageway restricting position for cooperatively progressively restricting said passageway in the direction of downstream movement of respective documents in said passageway such that said flexure springs exert decelerating forces on opposed major surfaces of respective documents in said passageway; and c. means for moving said flexure springs.

2. The apparatus according to claim 1, wherein each of said flexure springs includes a free end extending into said passageway and oriented to resist upstream movement of documents therein when said springs are disposed in said passageway restricting position, and said decelerating means including means for obstructing the passage of respective documents in said passageway.

3. The apparatus according to claim 1, wherein said decelerating means includes a third flexure spring having one end fixedly attached to one of the side walls of said platform for movement therewith, said third flexure spring longitudinally extending into said passageway upstream of said pair of flexure springs, and the other end of said third flexure spring disposed in said passageway for resisting upstream movement of respective documents in said passageway.

4. Apparatus for weighing documents of different thickness serially fed thereto, said apparatus comprising:

a. a scale including a weighing platform for receiving vertically oriented documents serially fed thereto, said platform constructed and arranged to form an elongated passageway having a bottom wall for guiding the respective lower edges of documents fed to said platform;

b. means for decelerating downstream movement of respective documents in said passageway, said decelerating means including a plurality of flexure springs, said decelerating means including means for moving said flexure springs into and out of said passageway; and c. means for blocking movement of respective documents in said passageway.

5. The apparatus according to claim 4, wherein said decelerating means includes a pair of fingers mounted for movement between a passageway restricting position and a non-passageway restricting position, said fingers extending into said passageway downstream of said flexure springs, and said blocking means including a stop extending into said passageway from at least one of said fingers when said fingers are in said passageway restricting position.

6. The apparatus according to claim 4, wherein each of said flexure springs includes a free end extending into said passageway and oriented to resist upstream movement of documents therein when said flexure springs are moved into said passageway.

7. The apparatus according to claim 4, wherein said moving means includes means for sensing the arrival of respective documents at a predetermined position in said passageway, and said moving means operatively connected to said sensing means for moving said flexure springs out of said passageway a predetermined time interval after sensing the arrival of respective documents, said time interval being sufficient to permit said respectively sensed documents to settle on said platform.

8. The apparatus according to claim 7, wherein said moving means including means for moving said flexure springs into said passageway after a second predetermined time interval sufficient to permit said respectively sensed documents to be weighed on said platform.

9. The apparatus according to claim 8 including means for timely feeding documents from said platform after being weighed thereon, said document feeding means including a plurality of D-shaped rollers closely associated with said decelarating means.

* * * * *